United States Patent [19]

Romani

[11] Patent Number: 4,706,326

[45] Date of Patent: Nov. 17, 1987

[54] DUAL MODE HAIR VACUUM AND DRYER UNIT

[75] Inventor: R. Marlene Romani, Indiana, Pa.

[73] Assignee: M.D.C. Romani, Inc., Indiana, Pa.

[21] Appl. No.: 899,566

[22] Filed: Aug. 22, 1986

[51] Int. Cl.[4] ..... A47L 5/36

[52] U.S. Cl. ..... 15/314; 15/326; 15/327 R; 15/330; 15/345; 15/352; 15/353; 15/405

[58] Field of Search ..... 15/314, 330, 347, 352, 15/326, 353, 327 R, 345, 339, 346, 405, 331, 328

[56] References Cited

U.S. PATENT DOCUMENTS

| | | | |
|---|---|---|---|
| 1,308,685 | 7/1919 | Di Salvio | 15/405 X |
| 1,661,553 | 3/1928 | Baar | 15/328 X |
| 1,896,933 | 2/1933 | Anastasi | 15/328 X |
| 2,668,315 | 2/1954 | Crosby | 15/339 X |
| 2,753,434 | 7/1956 | Storm | 15/330 X |
| 3,009,188 | 11/1961 | Martin | 15/330 |
| 3,238,556 | 3/1966 | Martin | 15/330 |
| 3,268,942 | 8/1966 | Rossnan | 15/346 |

*Primary Examiner*—Chris K. Moore

*Attorney, Agent, or Firm*—Michael R. Swartz; John R. Flanagan

[57] ABSTRACT

A dual mode hair vacuum and dryer unit includes a cabinet with separate upper and lower compartments. An air pump in the cabinet has its suction inlet in the lower compartment and pressure outlet in the upper compartment for creating airflow through the air pump from the lower to the upper compartment. An air filter is disposed across the suction inlet of the air pump. A vacuum attachment connects to an air inlet nozzle on the cabinet for communicating vacuum airflow from a vacuum nozzle to the suction inlet of the air pump, via the lower compartment, which entrains hair cuttings in the vacuum airflow. A dryer attachment connects to an air outlet nozzle on the cabinet for communicating positive pressure airflow from the pressure outlet of the air pump to a drying nozzle, via the upper compartment, to dry hair. A baffle member forces vacuum airflow to take an indirect path through the lower compartment whereby hair cuttings entrained in the airflow will settle out and collect within the lower compartment before reaching the air filter. The cabinet also has doors for gaining access to the upper and lower compartments and includes insulation for absorbing the sound of the air pump. Further, a baffle panel provides a sound absorbing barrier for reducing transmission of air pump sound across the upper compartment to the air outlet nozzle. The airflow through the air pump cools it and thereby is heated prior to being communicated to the dryer nozzle.

18 Claims, 6 Drawing Figures

DUAL MODE HAIR VACUUM AND DRYER UNIT

BACKGROUND OF THE INVENTION

1. Field of the Invention

The present invention relates generally to hair grooming and, more particularly, is concerned with a dual mode hair vacuum and dryer unit which fosters greater efficiencies in grooming operations.

2. Description of the Prior Art

Several different vacuum systems and attachments for hair clippers have appeared in the prior art. Representative of the prior art are the systems and attachments disclosed in U.S. Pat. Nos. to Padgett et al (3,295,200), Ligon (3,331,130 and 3,341,944) and Keane (3,613,237 and 3,797,111). While these patents are described in conjuction with clipping the hair of humans in barber shops, other systems and attachments are known in the prior art for use in conjunction with the grooming of pets in grooming parlors and shops. There are also systems and attachments adapted for use in conjunction with both human and pet grooming.

Most of the prior art vacuum systems appear to have generally the same arrangement overall. Typically, a suction head is attached to a hand-held clipper adjacent to its cutting head and is connected to one end of a flexible hose. The other end of the hose is connected directly or via an intermediate conduit to a vacuum unit which usually includes an electric motor for creating a vacuum in the hose. The vacuum condition draws air into the hose through the suction head, entraining hair cuttings in the air flow through the hose to the vacuum unit. The vacuum unit also may include a container in which are collected the hair cuttings carried in the air flow from the hose. After removal of the hair cuttings, the air flow is typically exhausted from the vacuum unit to the atmosphere and frequently to the exterior of the shop.

While the above-described overall arrangement of the prior art systems has generally improved the cleanliness of grooming shops, reduced the potential hazards to grooming personnel from breathing in hair cuttings and other matter, and made grooming easier, a need arises from time to time to make certain improvements which will solve problems that crop up and increase performance and productivity even further.

SUMMARY OF THE INVENTION

The present invention provides a dual mode hair vacuum and dryer unit designed to satisfy the aforementioned needs. The unit of the present invention incorporates many features which foster greater efficiencies in grooming operations, in addition to providing a cleaner grooming workplace and a more sanitary environment for grooming personnel. Some of the features adapt the unit for use both as a hair vacuum and a warm air hair dryer. When the unit is used in the hair drying mode, heat added to the vacuum airflow by cooling the motor of the unit, rather than being wasted by exhausting it to the atmosphere, is used productively to dry the pet which is commonly washed after being clipped. Other features substantially absorb much of the sound produced by the motor so as to create a relatively quiet operating unit which will not scare pets being groomed. Still other features provide ready access to the interior of the unit for removing collected hair cuttings and other matter, and for changing the air filter and servicing the motor.

Accordingly, the present invention is directed to a dual mode hair vacuum and dryer unit which includes: (a) housing means having separate compartments; (b) airflow-creating means having a suction inlet and a pressure outlet and being mounted within the housing means with its suction inlet in communication with one of the compartments and its pressure outlet in communication with the other of the compartments for creating a vacuum airflow from the one compartment to the suction inlet and a positive pressure air flow from the pressure outlet to the other compartment; (c) air inlet means on the housing means communicating with the one compartment; (d) air outlet means on the housing means communicating with the other compartment; (e) a vacuum attachment being adapted for connection to the air inlet means for communicating the vacuum airflow from outside of the housing means to the suction inlet of airflow-creating means, via the air inlet means and the one compartment of the housing means, so as to entrain hair cuttings and other matter in the vacuum airflow; (f) a dryer attachment being adapted for connection to the air outlet means for communicating the positive pressure airflow from the pressure outlet of the airflow-creating means to outside of the housing means, via the other compartment and the air outlet means of the housing means, to dry wet hair; and (g) means defined within the one compartment for collecting the hair cuttings and other matter entrained in the vacuum airflow from outside of the housing means before reaching the suction inlet of the airflow-creating means.

More particularly, the airflow-creating means is an air pump, such as a flow-through type vacuum motor with a fan, in which airflow through the motor is used to cool the same, whereby the airflow communicated to the dryer attachment from the pressure outlet of the air pump is heated by the motor of the air pump. Also, a layer of insulation is disposed within the compartments of the housing means for absorbing the operating sound of the motor.

Further, the collecting means is formed by an end of one compartment of the housing means being spaced from the air pump and by a baffle member mounted in the one compartment spaced from the end thereof and extending across a direct path of airflow from the air inlet means to the suction inlet of the air pump. In such position, the baffle member forces the airflow to follow an indirect path from the air inlet means in a first direction toward the compartment end, around the baffle member and then toward the suction inlet of the air pump in a second direction generally opposite the first direction. The hair cuttings and other matter entrained in the airflow settle out and are collected within the one compartment at the end thereof.

More specifically, the housing means is a cabinet having opposite exterior end walls, exterior side walls extending between the end walls and connected with one another and with the end walls, and an interior intermediate wall extending between and interconnecting the side walls and spaced from the end walls so as to define the separate compartments in side-by-side relation therein. Also, a baffle panel composed of sound insulation material is mounted to the intermediate wall and side walls within the other compartment of the cabinet and is spaced from the other of the end walls so as to extend across a direct path of sound propagation and airflow from the air pump to the air outlet means. In such position, the baffle panel defines a sound absorbing barrier for reducing transmission of air pump operating sound to the air outlet means and also forces the airflow to take an indirect path from the pressure outlet of the air pump toward the other end wall, around the baffle panel and then toward the air outlet means.

Still further, the vacuum attachment includes a vacuum nozzle adapted for communicating the vacuum airflow from the vacuum nozzle to the suction inlet of the air pump. The dryer attachment includes a dryer nozzle adapted for communicating the positive pressure airflow from the pressure outlet of the air pump to the drying nozzle. An air filter is disposed within the one compartment across the suction inlet of the air pump. Access doors are defined on the cabinet for providing access to the one compartment for changing the air filter and removing any matter collected within the one compartment, and for providing access to the other compartment for servicing the air pump.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
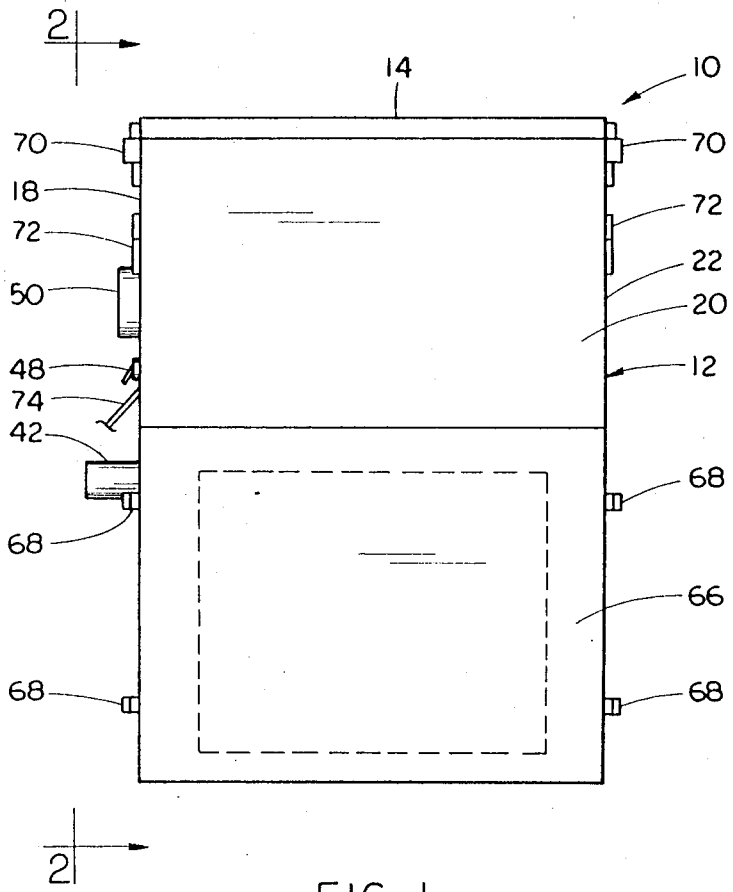
FIG. 1 is a front elevational view of the dual mode hair vacuum and dryer unit of the present invention.
Figure 2:
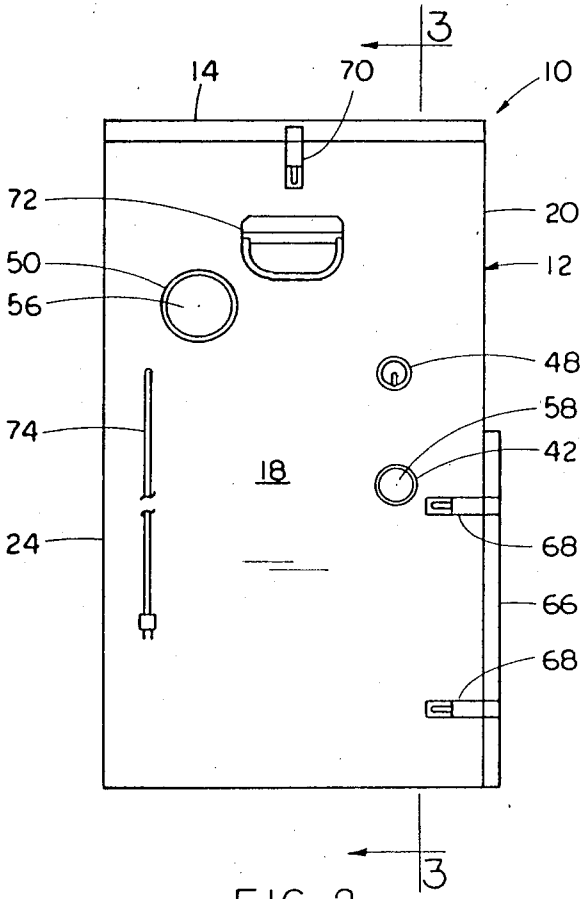
FIG. 2 is a side elevational view of the dual mode unit as seen along line 2—2 of FIG. 1.

In the following description, like reference characters designated like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIGS. 1 to 4, there is shown the preferred embodiment of the dual mode hair vacuum and dryer unit of the present invention, being generally 10. The dual mode unit 10 includes a generally rectangular, box-shaped cabinet 12 having a pair of opposite exterior top and bottom walls 14,16, four exterior side walls 18,20,22,24, and an interior transverse wall 26. The side walls 18–24 extend between the top and bottom walls 14,16 and are connected with one another and with the top and bottom walls. The interior transverse wall 26 extends between and interconnects the side walls 18–24 and is spaced from the top and bottom walls 14,16 so as to divide the cabinet into separate side-by-side, upper and lower hollow compartments 28,30. The cabinet 12 is normally oriented such that its top, transverse and bottom walls 14,26,16 extend in horizontal planes, whereas its side walls 18–24 extend in vertical planes.

The dual mode unit 10 uses an airflow-creating means in the form of an air pump 32, preferably being of a flow-through air-cooled type vacuum motor with a fan, such as commercially available from the Lamb Electric Division of AMETEK, Inc. The air pump 32 is mounted to the transverse intermediate wall 26 within the cabinet 12. A suction inlet 34 of the air pump 32 is disposed in the lower compartment 30, whereas a pressure outlet 36 of the air pump is disposed in the upper compartment 28 so that operation of the air pump 32 creates or causes a airflow through the air pump from the lower compartment 30 to the upper compartment 28. Also, an air filter 37 is disposed in the lower compartment 30, being maounted to the air pump 32 across its suction inlet 34. The filter 37 protects the air pump 32 from any contaminants, which includes hair cuttings, being carried by the airflow into the motor.

Figure 5:
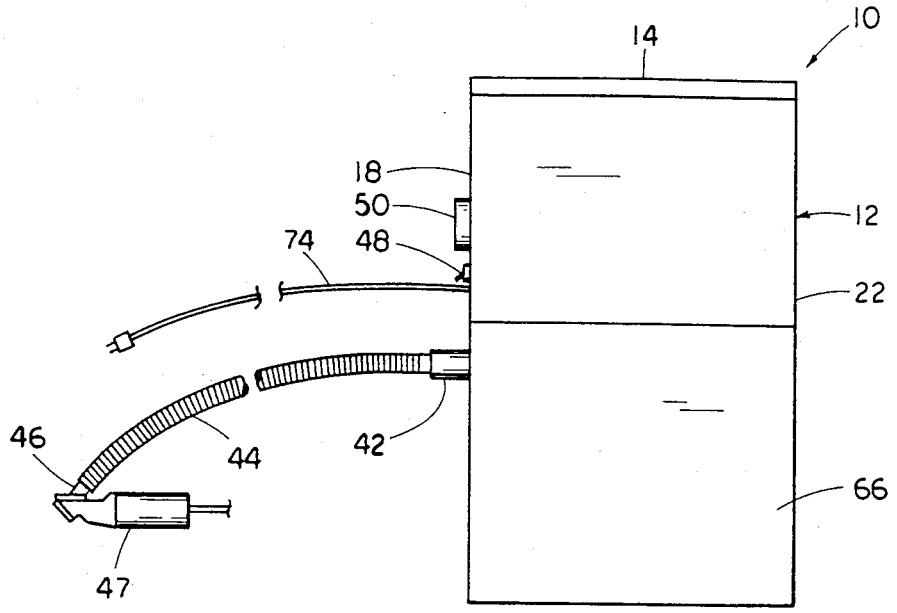
FIG. 5 is a schematical representation of the dual mode unit being illustrated in its hair mode.
Figure 6:
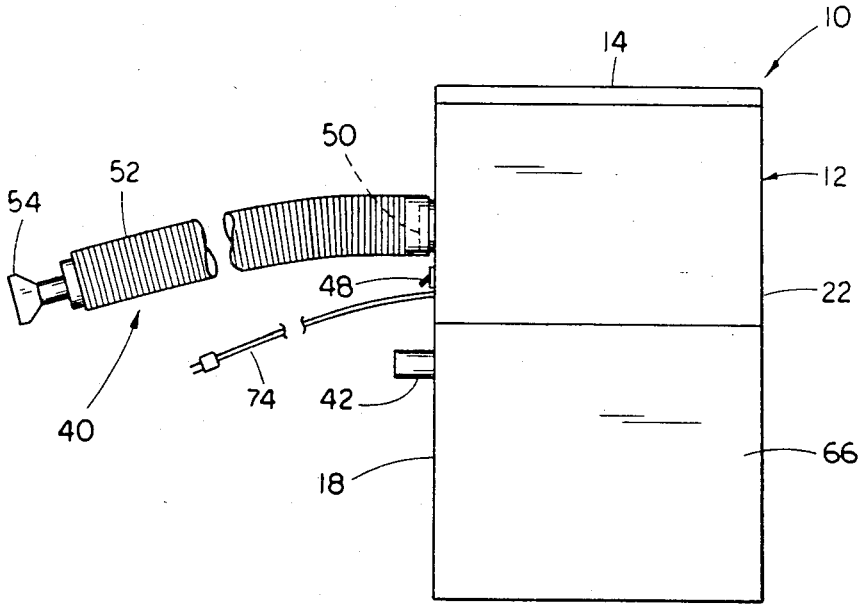
FIG. 6 is another schematical representation of the dual mode unit being illustrated in its hair drying mode.

For dual mode operation being depicted respectively in FIGS. 5 and 6, the unit 10 is adapted to utilize a vacuum attachment 38 (FIG. 5) and also a dryer attachment 40 (FIG. 6). For vacuum mode operation, an air inlet nozzle 42 is attached to the cabinet side wall 18 and connectible to one end of a flexible hose 44 of the vacuum attachment 38 for providing communication of a vacuum nozzle 46 on the opposite end of the hose 44 with the lower compartment 30. By way of example, the vacuum nozzle 46 can be one adapted for mounting on a hand-held hair clipper 47. Irrespective of the particular type of vacuum nozzle 46 being used, when the air pump 32 is turned on by actuation of a switch 48 on the cabinet side wall 18, the connection of the hose 44 to the air inlet nozzle 42 provides communication of a vacuum airflow, being created by the air pump 32, from the vacuum nozzle 46 to the suction inlet 34 of the air pump, via the lower compartment 30 of the cabinet 12, so as to entrain hair cuttings and other matter in the vacuum airflow being drawn into the vacuum nozzle.

For drying mode operation, either concurrently with, or at a time separate from, vacuum mode operation, an air outlet nozzle 50 is attached to the same cabinet side wall 18 (at a location above the air inlet nozzle 42) and connectible to one end of a flexible hose 52 of the dryer attachment 40 for providing communication of a dryer nozzle 54 on the opposite end of the hose 52 with the upper compartment 28. Via the upper compartment 28, therefore, a positive pressure airflow from the pressure outlet 36 of the air pump 32 is communicated to the dryer nozzle 54 of the dryer attachment 40 which then produces an outflow of air adapted to dry wet hair, for instance, of a freshly-washed pet. By comparison of nozzles 42,50 in FIG. 2, it will be seen that the air outlet nozzle 50 defines an opening 56 having a much larger diametric size than an opening 58 defined by the air inlet nozzle 42. Therefore, no impediment to the airflow through the air pump 32 will be caused by use of the dryer attachment 40.

Furthermore, it is not necessary that an external heater be available for use in heating the airflow. In view that the air pump 32 is a flow-through type vacuum motor with a fan in which airflow through the motor is used to cool it, the positive pressure airflow communicated to the dryer attachment 40 from the pressure outlet 36 of the air pump 32 is thus heated by the motor of the air pump. Therefore, hair drying can be carried out with the dryer attachment 40 by using heat which heretofore was wasted.

Figure 3:
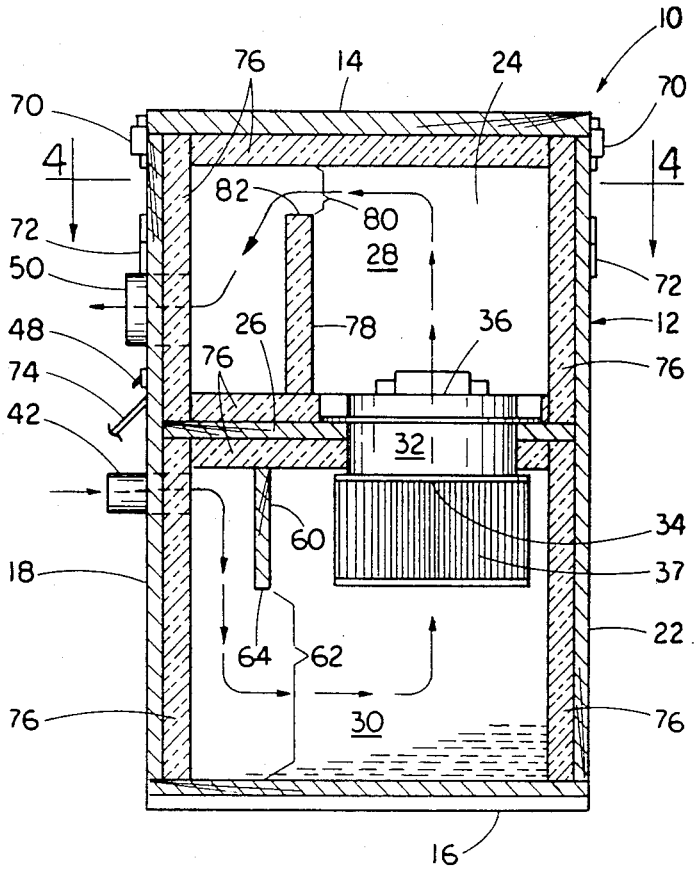
FIG. 3 is a vertical sectional view of the dual mode unit taken along line 3—3 of FIG. 2.
Figure 4:
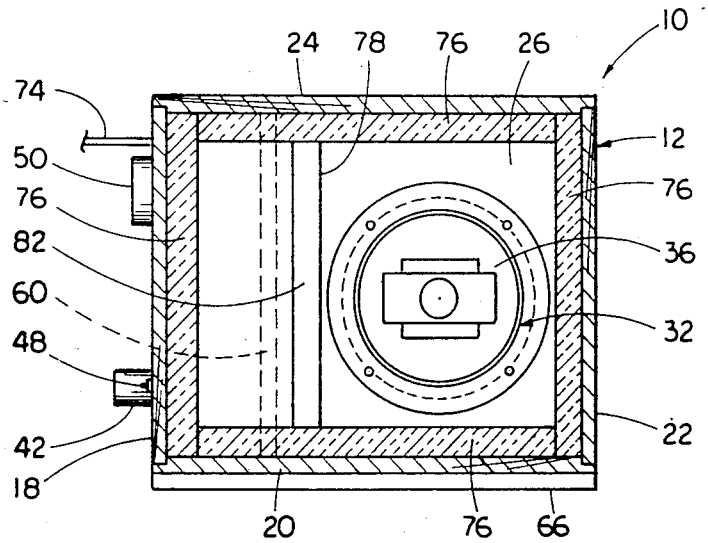
FIG. 4 is a horizontal sectional view of the dual mode unit taken along line 4—4 of FIG. 3.

The air filter 37 is designed to protect the air pump 32, but it is not intended to collect hair cuttings and other matter entrained in the vacuum airflow originating at the vacuum nozzle 46 of the vacuum attachment 38. Thus, other means must be provided for collection of such materials. As seen in FIG. 3, a baffle member 60 is provided to facilitate collection of such matter within the lower compartment 30 on the bottom wall 16 of the cabinet. The baffle member 60 is mounted to the intermediate transverse wall 26 and the opposite side walls 20,24 within the lower compartment 30. The baffle member 60 is spaced above the bottom wall 16 and extends across a direct path of airflow from the air inlet nozzle 42 to the suction inlet 34 of the air pump 32. The baffle member 60 defines an air gap 62 between it and the bottom wall 16 and forces the airflow to take an indirect path, as depicted by the arrows in FIG. 3, first from the air inlet nozzle 42 in a downward direction toward the bottom wall 16, then around a lower edge 64 of the baffle member 60 and through the air gap 62, and finally in an upward direction toward the air filter 37 disposed across the suction inlet 34 of the air pump 32. Substantially all of the hair cuttings and matter being carried in the airflow earlier will now settle out and collect within the lower compartment 30 before reaching the air filter 37.

The cabinet 12 of the unit 10 also has means for gaining acess to the upper and lower compartments 28,30. A lower front panel of door 66 is removably mounted by four releasable latches 68 mounted to the front lower edges of the side walls 18,22 and to the corners of the door. Removal of the front door 66 of the cabinet 12 provides ready access to the lower compartment 30 for both changing the air filter 37 and removing any matter collected within the lower compartment. The top wall 14 constitutes a removable door for gaining access to the upper compartment 28. The top wall 14 is removably mounted by a pair of releasable latches 70 on side walls 18,22 and on adjacent edges of the top wall. Removing the top wall 14 provides ready access to the upper compartment 28 for servicing the air pump 32. In addition, for moving and relocating the portable unit 10, a pair of carrying handles 72 are provided on the side walls 18,22 near their respective upper ends. Also shown at the one side wall 18 is a lead wire 74 for providing electrical power to the air pump 32 (the portion of the wire inside of the cabinet is not shown).

Most pets are easily scared by strange noises and bothered by noises above certain frequencies, thus it is important that the unit 10 be as quiet in its operation as feasible. For this purpose, a layer of insulation 76 is disposed within each of the compartments 28,30 along interior sides of the exterior side walls 18–24 and top wall 14 and both sides of the interior wall 26 for absorbing the operating sound of the air pump mounted within the cabinet. No insulation is usually needed on the interior of the bottom wall 16 as it rests on the floor of the shop.

In view of the large size of the opening 56 through the side wall 18 defined by the air outlet nozzle 50, additional means is provided to prevent air pump sounds from being emitted through the nozzle 50. A baffle panel 78 composed of sound insulation material is mounted to the intermediate wall 26 and the side walls 20,24 within the upper compartment 28. The baffle panel 78 is spaced below the top wall 14 and extends across a direct path of sound propagation and airflow from the air pump 32 to the air outlet nozzle 50. The baffle panel 78 thereby defines an air gap 80 between it and the top wall 14 and a sound absorbing barrier for reducing transmission of air pump operating sound to the air outlet nozzle 50. The baffle panel 78 forces the airflow to take an indirect path, as represented by the arrows in FIG. 3 through the upper compartment 28, from the pressure outlet 36 of the air pump 32 toward the top wall 14, around a top edge 82 of the baffle panel 78 and through the air gap 80, and then to the air outlet nozzle 50.

It is thought that the dual mode unit of the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What is claimed is:

1. A dual mode hair vacuum and dryer unit, comprising:

(a) housing means having separate compartments;

(b) airflow-creating means having a suction inlet and a pressure outlet and being mounted within said housing means with its suction inlet in communication with one of said compartments and its pressure outlet in communication with the other of said compartments for creating airflow from said one compartment to said other compartment;

(c) air inlet means on said housing means communicating with said one compartment;

(d) air outlet means on said housing means communicating with said other compartment;

(e) a vacuum attachment being adapted for connection to said air inlet means for communicating a vacuum airflow from outside of said housing means to said suction inlet of said airflow-creating means, via said air inlet means and said one compartment of said housing means, so as to entrain hair cuttings and other matter in said vacuum airflow;

(f) a dryer attachment being adapted for connection to said air outlet means for communicating said airflow-creating means to the outside of said housing means, via said other compartment and said air outlet means of said housing means, to dry wet hair; and (g) means defined within said one compartment for collecting hair cuttings and other matter entrained in said vacuum airflow from outside of said housing means before reaching said suction inlet of said airflow-creating means;

(h) said collecting means being formed by an end of said one compartment of said housing means being spaced from said airflow-creating means and by a baffle member mounted in said one compartment spaced from said end thereof and extending across a direct path of airflow from said air inlet means to said suction inlet of said airflow-creating means so as to force said airflow to follow an indirect path from said air inlet means in a first direction toward said compartment end, around said baffle member and then toward said suction inlet of said airflow-creating means in a second direction generally opposite said first direction, whereby hair cuttings and other matter entrained in said airflow will collect within said one compartment at said end thereof.

(d) an air outlet nozzle attached to one of said side walls and communicating with said other compartment, said outlet nozzle defining an opening larger in size than an opening defined by said inlet nozzle;

(e) an air filter disposed within said one compartment across said suction inlet of said air pump;

(f) a vacuum attachment having a vacuum nozzle and being adapted for connection to said air inlet nozzle for communicating a vacuum airflow from said vacuum nozzle to said suction inlet of said air pump, via said air inlet nozzle and said one compartment of said cabinet, so as to entrain hair cuttings and other matter in said vacuum airflow;

(g) a dryer attachment having a dryer nozzle and being adapted for connection to said air outlet nozzle for communicating a positive pressure airflow from said pressure outlet of said air pump to said drying nozzle, via said other compartment and said air outlet nozzle of said cabinet, to dry wet hair with said dryer nozzle;

(h) a baffle member mounted to said transverse wall and said side walls within said one compartment and spaced from one of said end walls so as to extend across a direct path of airflow from said air inlet nozzle to said suction inlet of said air pump, said baffle member thereby defining an air gap between it and said one end wall and an indirect path of airflow from said air inlet nozzle in a first direction toward said one end wall, around said baffle and through said air gap, and then toward said air filter across said suction inlet of said air pump in a second direction generally opposite said first direction, whereby any matter entrained in the airflow will settle out and collect within said one compartment before reaching said air filter;

(i) a first door defined in said cabinet for providing access to said one compartment for changing said air filter and removing any matter collected within said one compartment;

(j) a second door defined in said cabinet for providing access to the other of said compartments for servicing said air pump;

(k) a layer of insulation disposed within said compartments along interior sides of at least some of said exterior walls for absorbing the operating sound of said air pump mounted within said cabinet; and (l) a baffle panel composed of sound insulation material and mounted to said transverse wall and said side walls within said other compartment and spaced from the other of said end walls so as to extend across a direct path of sound propagation and airflow from said air pump to said air outlet nozzle, said baffle panel thereby defining a sound absorbing barrier for reducing transmission of air pump operating sound to said air outlet nozzle and further defining an air gap between it and said other end wall and an indirect path of airflow from said pressure outlet of said air pump toward said other end wall, around said baffle panel and through said air gap, and then toward said air outlet nozzle.

16. The dual mode unit as recited in claim 15, wherein said air pump is a flow-through type vacuum motor with a fan in which airflow through said motor is used to cool the same, whereby said positive pressure airflow communicated to said dryer attachment from said pressure outlet of said air pump is heated by said motor of said air pump.

17. A dual mode hair vacuum and dryer unit, comprising:

(a) housing means having separate compartments, said housing means being a cabinet having opposite exterior end walls, exterior side walls extending between said end walls and connected with one another and with said end walls, and an interior intermediate wall extending between and interconnecting said side walls and spaced from said end walls so as to define said separate compartments in side-by-side relation therein;

(b) airflow-creating means having a suction inlet and a pressure outlet and being mounted within said housing means with its suction inlet in communication with one of said compartments and its pressure outlet in communication with the other of said compartments for creating airflow from said one compartment to said other compartment;

(c) air inlet means on said housing means communicating with said one compartment;

(d) air outlet means on said housing means communicating with said other compartment;

(e) a vacuum attachment being adapted for connection to said air inlet means for communicating a vacuum airflow from outside of said housing means to said suction inlet of said power airflow-creating means, via said air inlet means and said one compartment of said housing means, so as to entrain hair cuttings and other matter in said vacuum airflow;

(f) a dryer attachment being adapted for connection to said air outlet means for communicating a positive pressure air flow from said pressure outlet of said airflow-creating means to outside of said housing means, via said other compartment and said air outlet means of said housing means, to dry wet hair; and (g) means defined within said one compartment for collecting hair cuttings and other matter entrained in said vacuum airflow from outside of said housing means before reaching said suction inlet of said airflow-creating means;

(h) said collecting means being formed by said end wall of said one compartment of said cabinet which is spaced from said airflow-creating means and by a baffle member mounted to said intermediate wall and side walls in said one compartment and spaced from said one end wall thereof, said baffle member extending across a direct path of airflow from said air inlet means to said suction inlet of said airflow-creating means so as to force said airflow to follow an indirect path from said air inlet means in a first direction toward said compartment end, around said baffle member and then toward said suction inlet of said airflow-creating means in a second direction generally opposite said first direction, whereby hair cuttings and other matter entrained in said airflow will collect within said one compartment at said end thereof.

18. A dual mode hair vacuum and dryer unit, comprising:

(a) housing means having separate compartments, said housing means being a cabinet having opposite exterior end walls, exterior side walls extending between said end walls and connected with one another and with said end walls, and an interior intermediate wall extending between and interconnecting said side walls and spaced from said end walls so as to define said separate compartments in side-by-side relation therein;

(b) airflow-creating means having a suction inlet and a pressure outlet and being mounted within said housing means with its suction inlet in communication with one of said compartments and its pressure outlet in communication with the other of said compartments for creating airflow from said one compartment to said other compartment;

(c) air inlet means on said housing means communicating with said one compartment;

(d) air outlet means on said housing means communicating with said other compartment;

(e) a vacuum attachment being adapted for connection to said air inlet means for communicating a vacuum airflow from outside of said housing means to said suction inlet of said airflow-creating means, via said air inlet means and said one compartment of said housing means, so as to entrain hair cuttings and other matter in said vacuum airflow;

(f) a dryer attachment being adapted for connection to said air outlet means for communicating a positive pressure air flow from said pressure outlet of said airflow-creating means to outside of said housing means, via said other compartment and said air outlet means of said housing means, to dry wet hair; and (g) means defined within said one compartment for collecting hair cuttings and other matter entrained in said vacuum airflow from outside of said housing means before reaching said suction inlet of said airflow-creating means;

(h) a baffle panel composed of sound insulation material and mounted to said intermediate wall and said side walls within said other compartment and spaced from the other of said end walls so as to extend across a direct path of sound propagation and airflow from said airflow-creating means to said air outlet means, said baffle panel thereby defining a sound absorbing barrier for reducing transmission of airflow-creating means operating sound to said air outlet means and further forcing said airflow to take an indirect path from said pressure outlet of said airflow-creating means toward said other end wall, around said baffle panel and then toward said air outlet means.

* * * * *